US005388825A

United States Patent [19]

Myers et al.

[11] Patent Number: 5,388,825

[45] Date of Patent: Feb. 14, 1995

[54] ILLUMINABLE BALL

[75] Inventors: Jeff D. Myers, Paradise Valley; Roger S. Dollison, Phoenix, both of Ariz.

[73] Assignee: Myers Innovation Group, Paradise Valley, Ariz.

[21] Appl. No.: 185,041

[22] Filed: Jan. 24, 1994

[51] Int. Cl.[6] ..... A63B 43/06

[52] U.S. Cl. ..... 273/58 G

[58] Field of Search ..... 273/58 G

[56] References Cited

U.S. PATENT DOCUMENTS

| | | | |
|---|---|---|---|
| 2,020,484 | 11/1935 | Turner | 273/58 G |
| 2,903,820 | 9/1959 | Bodell | 273/58 G X |
| 3,804,411 | 4/1974 | Hendry | 273/58 G |
| 4,801,141 | 1/1989 | Rumsey | 273/58 G X |
| 5,054,778 | 10/1991 | Maleyko | 273/58 G |
| 5,145,473 | 9/1992 | Henry | 273/58 G X |

*Primary Examiner*—William H. Grieb

*Attorney, Agent, or Firm*—Warren F. B. Lindsley

[57] ABSTRACT

A hollow illuminable ball formed of a resilient foam material having a battery, bulb and an on/off switch mounted in its hollow interior with the switch operable by finger of a user compressing the foam material juxtapositioned the switch for selectively actuating the switch for illuminating the ball.

11 Claims, 3 Drawing Sheets

ILLUMINABLE BALL

BACKGROUND OF THE INVENTION

In connection with sports and games, a ball in various sizes has been in universal usage since ancient times. The Greeks regarded ball-games as of much value in adding grace to the figure and giving elasticity to the muscles of the body and the Romans also played a game of ball in connection with their baths for the same purpose. Today, a variety of balls are used in different sporting events.

DESCRIPTION OF THE PRIOR ART

Numerous types and sizes of balls are used for various games such as, among other things, baseball comprising a sphere of rubber 2½ ounces in weight which is wound with yarn and covered with leather. The basketball is an inflated rubber ball, enclosed in leather and ranging in size from 30 to 32 inches in circumference. A tennis ball is formed of rubber covered with white flannel about 2½ inches in diameter and 2 ounces in weight. The lacrosse ball is made of india-rubber and is 8 or 9 inches in diameter. The polo ball is made of wood of about 4 or 5 inches in diameter. The football is a prolate spheroid in shape and consists of a rubber bladder encased in a leather cover.

None of the balls are illuminated from within.

SUMMARY OF THE INVENTION

In accordance with the invention claimed, a new and improved foam ball is disclosed which is selectively illuminated from within and is usable in various sizes and shapes for individual and group night time games.

It is, therefore, one object of this invention to provide a new and improved selectively illuminable ball.

Another object of this invention is to provide a selectively illuminable bouncing ball.

A further object of this invention is to provide a new and improved foam covered illuminable ball.

A still further object of this invention is to provide a new and improved selectively illuminable relatively rigid core covered by a foam plastic or rubber outer cover.

A still further object of this invention is to provide a selectively illuminable inner core of a ball the switch of which is embedded in a cover of the core and reachable by compressing a point or area on the cover.

A still further object of this invention is to provide an alternate embodiment wherein the internal illumination is caused to flash on and off at a predetermined frequency and duty cycle.

Further objects and advantages of this invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Referring more particularly to the drawings by characters of reference, FIGS. 1–4 disclose a hollow ball 10 which may be formed of a resilient foam such as a rubber or poly plastic material 11 having a rigid core assembly 12 mounted within its hollow interior.

The hollow foam ball houses a battery powered mechanism in its hollow interior which with its on/off switch actuates one or more light bulbs to brightly illuminate a sphere forming the ball. The foam material forming a housing for the ball acts as a shock dampening material, allowing the ball to sustain impacts which would otherwise not be possible. The foam housing provides a safe and soft material for children of all ages to play with. The ball may be housed in plastic or rubber covered by foam.

The core assembly may comprise any suitable mechanical on/off switch assembly which may be operable from without the ball by an operator compressing the rubber or plastic foam material over the switch enough to reach the on/off or momentary switches 13 of the core assembly 12.

Figure 5:
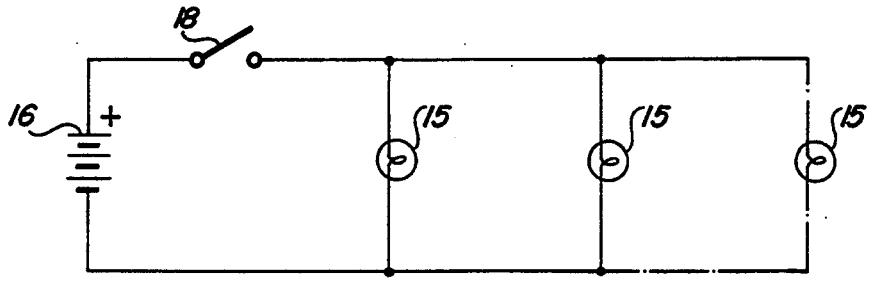
FIG. 5 is a wiring diagram showing a first embodiment of the circuitry useable with the ball shown in FIGS. 1–4.

The core assembly 12 may further comprise any suitable rigid frame 14 supporting within it one or more bulbs 15 in a series or parallel arrangement energized by a DC battery 16, as shown in FIG. 5.

In this simplest form of the invention, switch 13 is preferably of the type which changes state from open to closed or from closed to open each time its mechanism is depressed. In this case, the user closes the switch 13 to energize bulbs 15 at the start of play and opens it again at the end of play. It has the disadvantage that if the user fails to open the switch at the end of the playing period, the batteries will lose their charge during an extended period of disuse.

Figure 6:
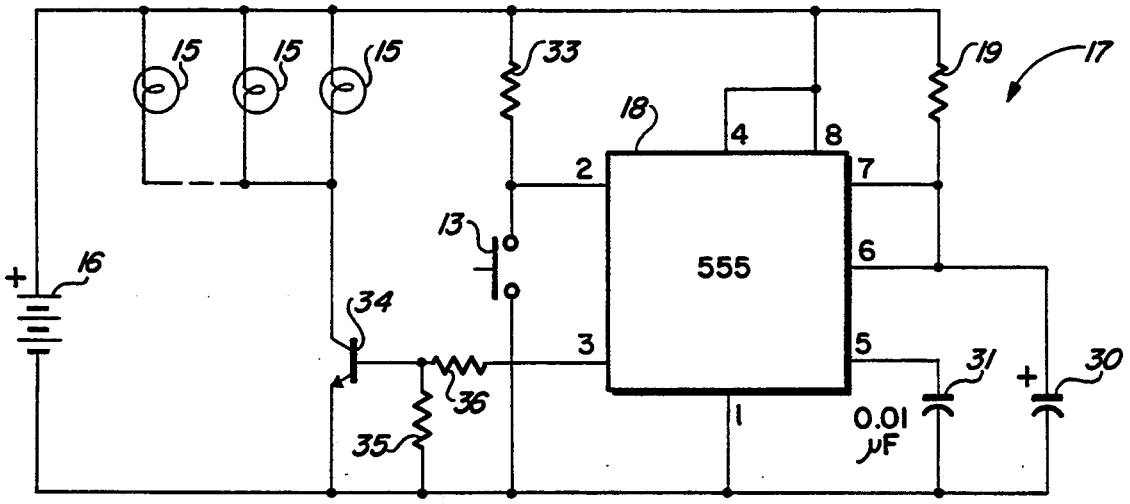
FIG. 6 is a wiring diagram of a second embodiment of the invention incorporating a timing circuit for automatically turning off the illumination after a predetermined time.

The second embodiment of the invention incorporates a 555 timer 18, as shown in FIG. 6, to insure that bulbs 15 will not remain energized for long periods of disuse.

The 555 timer is a commonly used integrated circuit that is available from a number of manufacturers.

Raytheon supplies the device as part number RC 555 and provides functional descriptions of the part for various connections of external components (See Raytheon data book, LINEAR INTEGRATED CIRCUITS, COPYRIGHT 1984 RAYTHEON COMPANY, pages 12-2 through 12-8). The 555 timer may be operated as a monostable timer or as an astable square wave multivibrator. When connected as a monstable timer the 555 timer is capable of timing periods from microseconds to hours. The timing period is controlled by two external parts (a resistor and a capacitor). When connected for astable operation, the circuit output alternates between high and low with its frequency and duty cycle determined by three external components (two resistors and a capacitor).

In the illumination circuit 17 of FIG. 6, the 555 timer 18 is connected for monostable operation. The ground terminal, pin 1 is connected to the negative terminal of battery 16; the Vs terminal 8 and the reset terminal 4 are connected to the positive terminal of battery 16. A timing resistor 19 is connected between timer pin 8 and pins 6 and 7, and a timing capacitor 30 is connected from pins 6 and 7 to ground pin 1. A noise suppression capacitor 31 (0.01uF) is connected from pin 5 to pin 1. A trigger circuit comprising momentary switch 13 and pull-up resistor 33 is connected to trigger terminal 3 with resistor 33 connected between timer pins 3 and 8 and with switch 13 connected between timer pins 3 and 1.

One or more incandescent light bulbs 15 in a parallel arrangement are connected across battery 16 through an NPN transistor 34. One end of each bulb 15 is connected to the positive terminal of battery 16; the other end of each bulb is connected to the collector of transistor 34. The base of transistor 34 is driven by timer output pin 3 through a biasing network comprising resistors 35 and 36. Resistor 35 is connected from the base of transistor 34 to the emitter of transistor 34 to insure that the transistor is "off" when the timer output is low; resistor 36 is connected between the base and pin 3 to limit base drive current when the timer output is high.

The operation of the illuminating circuit 17 proceeds as follows:

In the "off" state, capacitor 30 is held in a discharged state by a transistor internal to the timer 18, and the output of timer 18 at pin 3 is low so that transistor 34 is "off" and bulbs 15 are not energized.

An "on" period is initiated by momentarily closing switch 13. This drives trigger pin 2 in the negative direction and sets a flip-flop internal to timer 18, driving the output at pin 3 high and releasing the short circuit across the external timing capacitor 30 by turning off the internal transistor.

The high output at pin 3 turns transistor 34 on energizing bulbs 15. At the same time, the timing capacitor 30 begins to charge through timing resistor 19 with a time constant Tc=RAC where RA is the ohmic value of resistor 19 and C is the capacitance of timing capacitor 20. When the voltage of capacitor 30 reaches a level equal to $\frac{2}{3}$ the value of the battery 16 voltage a comparator internal to timer 17 resets the internal flip-flop and discharges capacitor 30. The output at pin 3 is now low, transistor 24 is off and bulbs 15 are de-energized.

An appropriate selection of the values of resistor 19 and capacitor 30 yields the desired "on" time of bulbs 15.

The illumination circuit 17 of FIG. 6 draws negligible current from battery 16 when bulbs 15 are not energized. If playing time exceeds the "on" time of the circuit, the circuit may be triggered again for another period of play.

Figure 7:
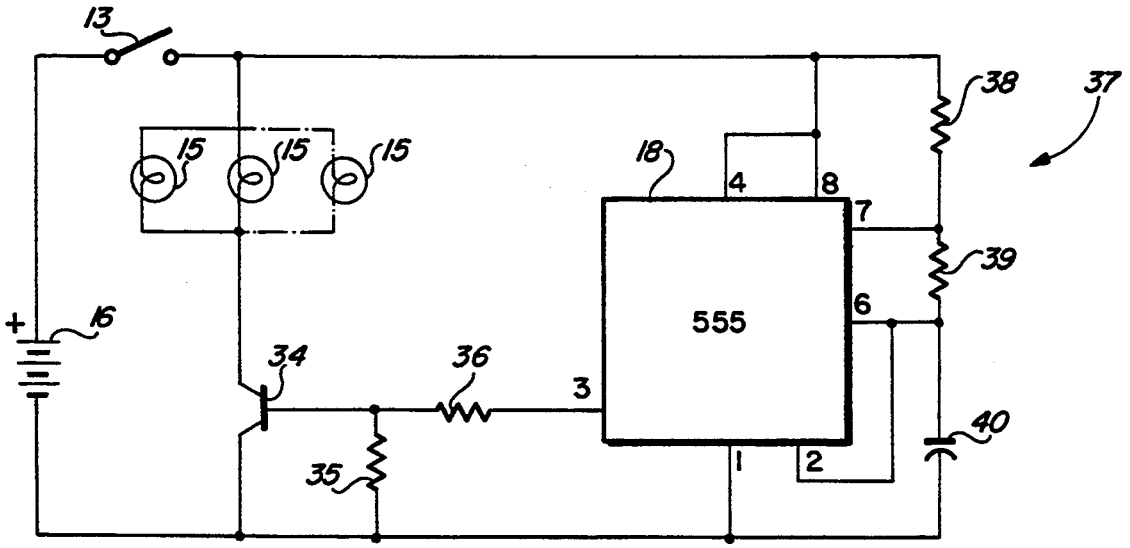
FIG. 7 is a wiring diagram of a third embodiment of the invention in which the illumination is made to flash on and off at a predetermined frequency and duty cycle while the switch is closed.

In the alternate embodiment of the invention, as shown in the illumination circuit 37 of FIG. 7, timer 18 is connected for astable operation with a first timing resistor 38 connected from pin 7 to pin 8, a second timing resistor 39 connected between pins 6 and 7 and a timing capacitor 40 connected between pins 1 and 6. Trigger pin 2 is connected to pin 6 and a timing capacitor 40 is connected between pin 6 and ground pin 1. The ground terminal pin 1 is connected to the negative terminal of battery 16 and the positive supply terminal pin 8 is connected to the positive terminal of battery 16 through an alternate action switch 13. As in the case of illumination circuit 17, bulbs 15 are connected in a parallel arrangement, with each bulb having one terminal connected to the positive battery terminal, in this case through switch 13, and with the other terminal connected to the collector of transistor 34. Transistor 34 and its biasing network, resistors 35 and 36, are connected in the same way as described for circuit 17.

With timer 18 connected, as shown in FIG. 7, it will trigger itself and free run as a multivibrator. The timing capacitor 40 charges through resistors 38 and 39 and discharges through resistor 39 only. The duty cycle is thus set by the ratio of these two resistors, and capacitor 40 charges and discharges between $\frac{1}{3}$ Vs and 213 Vs where Vs is the voltage of battery 16 (preferably equal to 9VDC for the circuits of FIGS. 6 and 7). Charge and discharge times, and therefore frequency, are independent of battery voltage. During the charging period of capacitor 40, the output terminal 3 of timer 18 is high and bulbs 15 are energized; during the discharging period of capacitor 40 the output at pin 3 is low and bulbs 15 are not energized.

The multivibrator action and the resulting flashing operation of bulbs 15 is enabled by the closing of on/off switch 13 which is preferably an alternate action switch. It is alternately opened and closed by each successive depression of its mechanism.

It should be recognized that various changes and modifications of the invention including details of the wiring diagrams are held to be within the scope of this invention. Such changes and modifications include the substitution of new and improved timing circuits, switch types, and series rather than parallel arrangements of bulbs 15. In the case of illumination circuit 17, it is also possible to incorporate an on/off switch in series with battery 16 to reduce battery drain to zero during periods of disuse. In this case, an automatic trigger operation can be improvised.

Figure 1:
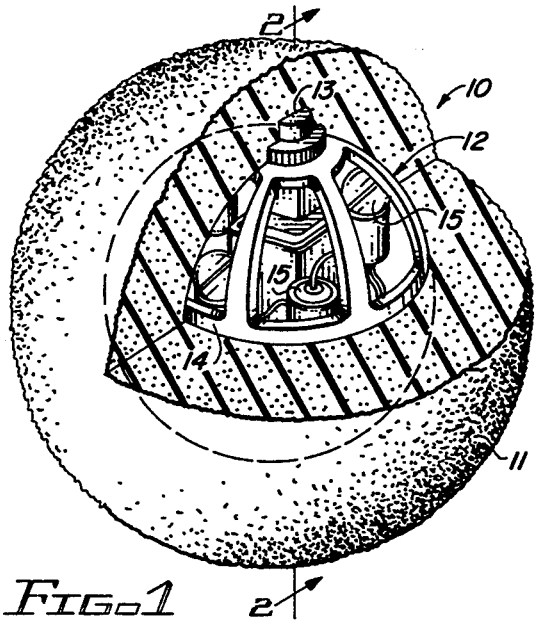
FIG. 1 is a partially broken away perspective view of an illuminable ball embodying the invention.
Figure 2:
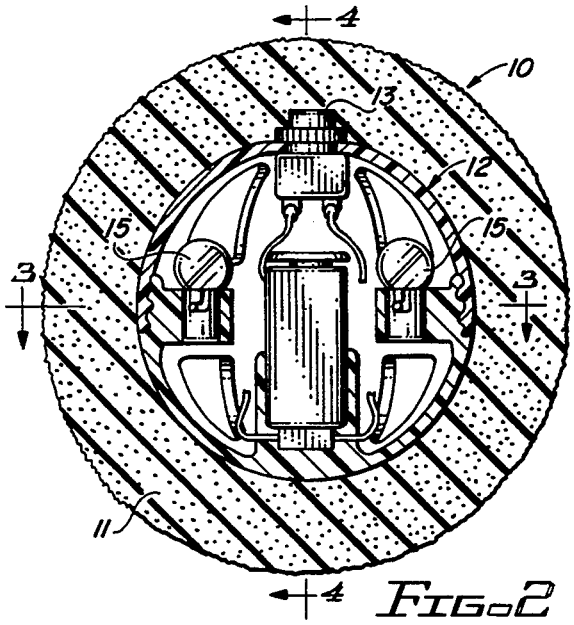
FIG. 2 is a cross sectional view of FIG. 1 taken along the line 2—2.
Figure 3:
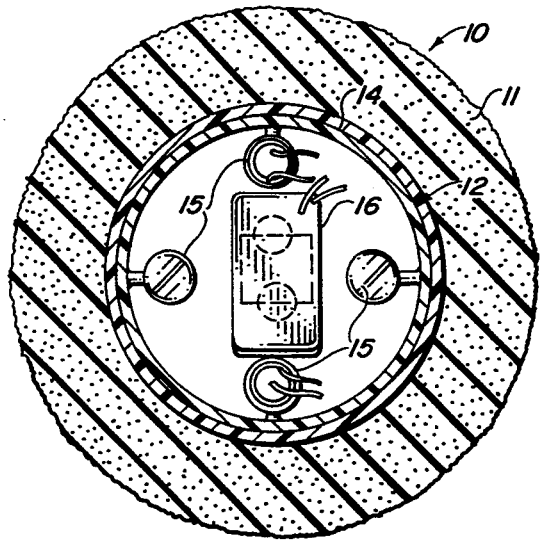
FIG. 3 is a cross sectional view of FIG. 2 taken along the line 3—3.
Figure 4:
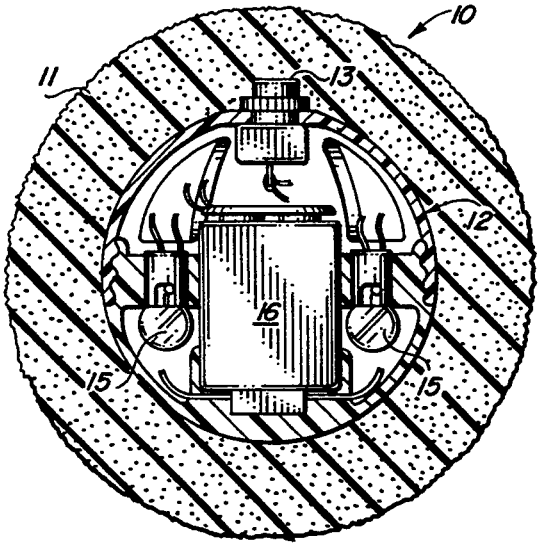
FIG. 4 is a cross sectional view of FIG. 2 taken along the line 4—4.
Figure 8:
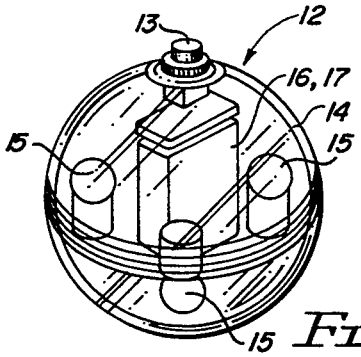
FIG. 8 is a perspective view of the lighting cubicle shown in FIG. 1.

Timer 17, battery 16, bulb or bulbs 15 and on/off operated switch 13 are all secured within frame 14 of the core assembly 12 as shown in FIG. 8. This core assembly is then inserted with a tight fit into the hollow interior of ball 10 and the two halves of the ball are then suitably secured together.

Figure 9:
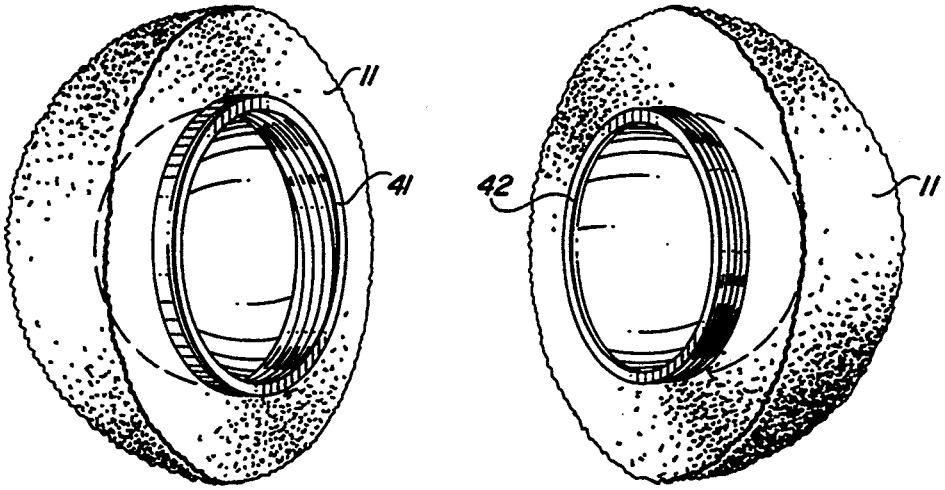
FIG. 9 is an exploded view of two semispherical halves of a ball threadedly interconnected.

As shown in FIG. 9, ball 10 comprising two hollow halves formed of a suitable rubber or plastic foam, is glued to two inserted ring mechanisms 41 and 42 which interlock or snap together when the two halves of the ball are secured together with the core assembly in the ball thereby forming a complete illuminable ball assembly.

In FIG. 9, the insertable mechanisms 41 and 42 glued one to the hollow interior of each half of the ball form a ring which are threadedly engageable.

Figure 10:
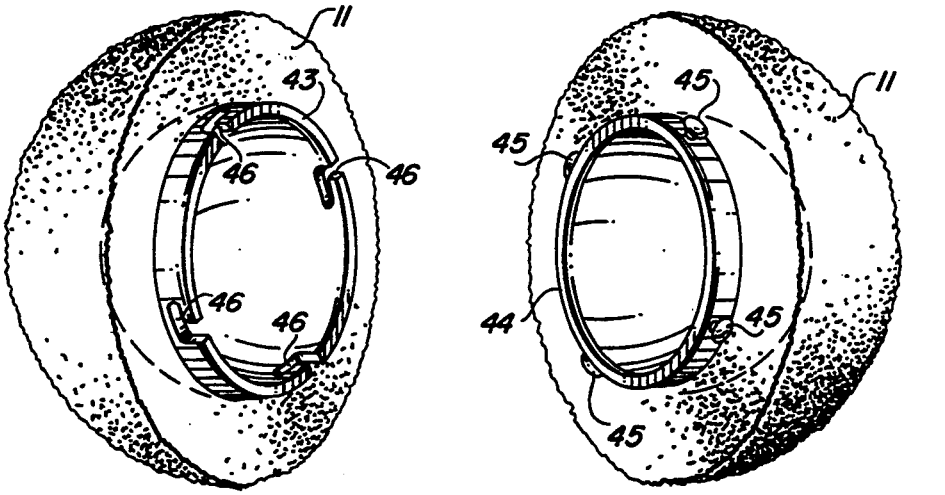
FIG. 10 is an exploded view of two halves of a ball interconnected by an interlocking slot and pin arrangement.

In FIG. 10, the insertable ring mechanisms 43 and 44 which are glued each to the interiors of the hollow opening of a different one of the semi spherical halves forming the ball comprise an interlocking arrangement with pins 45 of the ring mechanism 44 fitting into slots 46 of ring mechanism 43.

This pin and slot arrangement interlock in a known manner when pins 45 are inserted in slots 46 and then turned slightly to cause the pins to enter the lateral portion of the slots.

Figure 11:
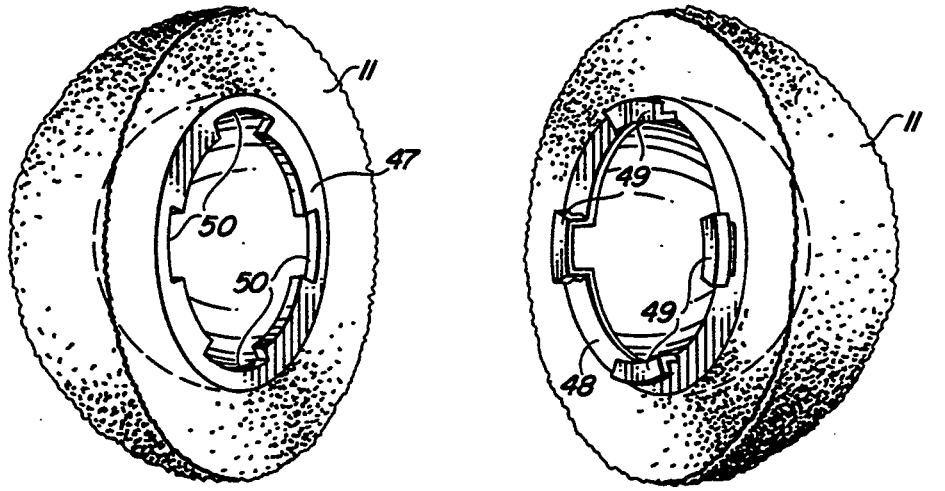
FIG. 11 is an exploded view of two halves of a sphere interconnected by a further interlocking slot and pin arrangement.

In FIG. 11, the insertable ring mechanisms 47 and 48 comprise a clamp for holding the halves of the ball in a detachable arrangement.

The male clamp projections 49 of ring mechanism 48 are insertable in the female slots 50 of ring mechanism 47 and then one half of the sphere twisted relative to the other to interlock the parts of the sphere together.

As in FIG. 9, the ring mechanisms 43, 44 and 47, 48 of FIGS. 10 and 11 are suitably secured to the interior of the ball to form a ball the halves of which may be connected and disconnected for service purposes.

The invention has now been described with reference to a specific embodiment. Various modifications and substitutions will be apparent to persons skilled in the relevant arts. Accordingly, it is not intended that the invention be limited to the specific embodiment described herein, but is defined by the appended claims.

What is claimed is:

1. An illuminable ball comprising:

a sphere formed of an exterior resilient material overlaying a hollow rigid core, the sphere comprising two engageable halves, means for detachably connecting the halves of said sphere together mounted on said core, an illuminating means mounted within the hollow core of said sphere, said illuminating means comprising a D.C. battery, at least one bulb, an on/off switch and a circuit for interconnecting said bulb and said switch with said battery for controlled illumination of said bulb, said switch being positioned to extend outwardly of the hollow core of said sphere and into said resilient material, whereby when said resilient material over said switch is compressed by the fingers of a user it may be compressed enough to reach said switch for operation thereof.

2. The illuminable ball set forth in claim 1 wherein: said resilient material comprises a foam rubber material of any color.

3. The illuminable ball set forth in claim 1 wherein: said resilient material comprises foam, rubber or plastic material of any color.

4. The illuminable ball set forth in claim 3 wherein: said resilient material comprises a poly foam material or foam rubber.

5. The illuminable ball set forth in claim 1 wherein: said means for detachably connecting the halves of said sphere together comprises two engageable parts one secured to the opening of each half of said sphere.

6. The illuminable ball set forth in claim 5 wherein: said engageable parts comprise two rings one secured to each opening of the halves of said sphere.

7. The illuminable ball set forth in claim 6 wherein: one ring is provided with a protrusion for engaging in a locking arrangement with a slot in the other of said rings.

8. The illuminable ball set forth in claim 1 wherein: more than one bulb is spacedly arranged in the hollow core of the sphere.

9. The illuminable ball set forth in claim 1 in further combination with:

a timer interconnected by said circuit with said battery, said bulb and said on/off switch to control the length of time of the illumination of said bulb.

10. The illuminable ball set forth in claim 1 in further combination with:

a means connected by said circuit with said battery, said bulb and said on/off switch for timed opening and closing of said circuit for flashing said bulb.

11. The illuminable bulb set forth in claim 10 wherein: said means comprises a multivibrator.

* * * * *